US006639622B2

(12) United States Patent
Kerr

(10) Patent No.: US 6,639,622 B2
(45) Date of Patent: Oct. 28, 2003

(54) IMAGING DRUM WITH AUTOMATIC BALANCE CORRECTION

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 61 days.

(21) Appl. No.: 10/054,081

(22) Filed: Jan. 21, 2002

(65) Prior Publication Data

US 2003/0137581 A1 Jul. 24, 2003

(51) Int. Cl.[7] ..... B41J 2/435

(52) U.S. Cl. ..... 347/264; 347/262

(58) Field of Search ..... 347/262, 264, 347/153, 220, 221; 101/483; 210/391; 301/5.21, 5.22; 346/103, 138

(56) References Cited

U.S. PATENT DOCUMENTS 2,895,766 A * 7/1959 Leopold, Jr. ..... 301/5.22
5,428,371 A * 6/1995 Fox et al. ..... 347/262
5,753,119 A * 5/1998 Beard ..... 210/391
5,813,346 A * 9/1998 Solomon ..... 101/483

* cited by examiner

*Primary Examiner*—Hai Pham
(74) *Attorney, Agent, or Firm*—Buskop Law Group, P.C.

(57) ABSTRACT

A self-balancing imaging drum (300) for supporting print media (32) includes an external surface (303) having a plurality of vacuum holes (306) extending from the hollowed-out interior portion (304) of the self-balancing imaging drum (300). A first vacuum supply (450) is formed in the hollowed-out interior portion (304) thereby communicating vacuum through the plurality of vacuum holes (306) for holding print media (32) onto the external surface (303) of the self-balancing imaging drum (300). At least one balance corrector (490) consists of a vacuum cylinder (480) for housing a vacuum piston (470) with a return spring (460) mounted in the wall of the self-balancing imaging drum (300) such that when the self-balancing imaging drum (300) is rotated it generates a second vacuum supply (440) to the external surface (303) of the self-balancing imaging drum (300) for holding the print media (32). If no print media (32) is present the vacuum piston (470) moves outwardly to correct the balance of the self-balancing imaging drum (300). The self-balancing imaging drum (300) has a large number of balance correctors (490) disposed in the wall of the self-balancing imaging drum (300).

23 Claims, 6 Drawing Sheets

IMAGING DRUM WITH AUTOMATIC BALANCE CORRECTION

FIELD OF THE INVENTION

The present invention relates to an image processing apparatus and method for exposing an intended image on an imaging drum to form a pre-press proof used in the printing industry but not limited to, and, more particular, to an image processing apparatus incorporating an imaging drum having automatic balance correction.

BACKGROUND OF THE INVENTION

Pre-press proofing is a procedure that is used mainly by the printing industry for creating representative images of printed material without the cost and time required to produce printing plates and set up a high-speed, high volume, printing press to produce an example of an intended image. An intended image may require several corrections and be reproduced several times to satisfy or meet, customers requirements resulting in higher costs and a loss of profits which ultimately would be passed onto the customer.

One such commercially available image processing apparatus is arranged to form an intended image on a sheet of print media. Colorant is transferred, from a sheet of donor material to the print media by applying a sufficient amount of energy to the donor sheet material to form an intended image on the print media. The above mentioned image processing apparatus generally includes a material supply assembly or carousel, and a lathe bed scanning subsystem or write engine, which includes a lathe bed scanning frame, translation drive, translation stage member, printhead, load roller, imaging drum, print media exit transport, and dye donor sheet material exit transport.

Operation of the image processing apparatus generally includes metering a length of the print media (in roll form) from the material assembly or carousel. The print media is then cut into sheet form of the required length and transported to the imaging drum. It is then wrapped around and secured onto the imaging drum. A load roller, which is also known as a squeegee roller, aids in removing any entrained air between the imaging drum and the print media. Next, a length of donor material (in roll form) is metered out of the material supply assembly or carousel, and cut into sheet form of the required length. It is then transported to the imaging drum and wrapped around the periphery of the imaging drum. The load roller removes any air entrained between the imaging drum, print media, and the donor sheet material. The donor sheet material is superposed in the desired registration with respect to the print media, which has already been secured to the imaging drum.

After the donor sheet material is secured to the periphery of the imaging drum, the scanning subsystem or write engine, provides the scanning function. This is accomplished by retaining the print media and the donor sheet material on the imaging drum while it is rotated past the printhead as the translation drive traverses both the printhead and translation stage member axially along the axis of the imaging drum in coordinated motion with the rotating imaging drum. These movements combine to produce the intended image on the print media.

After an intended image has been formed on the print media, the donor sheet material is removed from the imaging drum without disturbing the print media beneath it. The donor sheet material is then transported out of the image processing apparatus to a waste bin. Additional donor sheet materials are sequentially superimposed with the print media on the imaging drum, further producing an intended image. With the completed intended image formed on the print media it is then unloaded from the imaging drum and transported to an external holding tray on the image processing apparatus.

Although the presently known and utilized image processing apparatus is satisfactory, a need exists to allow for self-balancing correction of an imaging drum during rotation with different sizes of media.

SUMMARY OF THE INVENTION

A self-balancing image processing apparatus for writing intended images to print media comprises a self-balancing imaging drum having an external surface with a plurality of vacuum holes for supporting the print media. A printhead forms an intended image on the print media. A drive motor rotates the self-balancing imaging drum. A blower creates a first vacuum supply to the self-balancing imaging drum for holding the print media on the external surface of the self-balancing imaging drum. At least one balance corrector consists of a vacuum cylinder for housing a vacuum piston with a return spring mounted in the wall of the self-balancing imaging drum, for creating a second vacuum supply to the external surface for holding the print media. The balance corrector is adapted to allow the vacuum piston to move outwardly to compensate for the lack of print media on the external surface of the self-balancing imaging drum thus correcting the balance of the self-balancing imaging drum. In the most preferred embodiment, the self-balancing imaging drum has a large number of balance correctors disposed in the wall of the self-balancing imaging drum.

A method for loading and unloading print media from a self-balancing imaging drum comprises creating a first vacuum supply in a hollowed-out interior portion. The self-balancing imaging drum having an external surface with a plurality of vacuum holes communicates with the first vacuum supply within the hollowed-out interior portion the of the self-balancing imaging drum. The print media is loaded on the external surface of the self-balancing imaging drum. The print media is held on the external surface by means of a vacuum drawn through the plurality of vacuum holes on the external surface. The self-balancing imaging drum is rotated forming a second vacuum supply to the external surface of the self-balancing imaging drum during rotation using at least one balance corrector consisting of a vacuum cylinder for housing a vacuum piston with a return spring mounted in the wall of the self-balancing imaging drum. If no print media is disposed over at least one of the balance correctors, the balance corrector allows a vacuum piston to move outwardly to compensate for the lack of print media on the external surface of the self-balancing imaging drum correcting the balance of the self-balancing imaging drum.

In the operation of the invention, it is contemplated that the vacuum level of the first vacuum supply may be varied using a vacuum supply controller. For the second vacuum supply it is contemplated that it could also be varied with a vacuum supply controller, but more preferably the second vacuum supply is varied with the rotational speed of the self-balancing imaging drum, and no additional equipment is needed, reducing the expense of the equipment. If a vacuum supply controller is used, it is contemplated that the vacuum supply controller can vary the speed of the blower by pulse width modulation of the DC voltage level to the blower.

A self-balancing imaging drum for supporting print media comprises an external surface having a plurality of vacuum holes extending from the hollowed-out interior portion of the self-balancing imaging drum. A first vacuum supply is formed in the hollowed-out interior portion thereby communicating vacuum through the plurality of vacuum holes for holding print media onto the external surface of the self-balancing imaging drum. At least one balance corrector consists of a vacuum cylinder for housing a vacuum piston with a return spring mounted in the wall of the self-balancing imaging drum such that when the self-balancing imaging drum is rotated it generates a second vacuum supply to the external surface of the self-balancing imaging drum for holding the print media. If no print media is present the vacuum piston moves outwardly to correct the balance of the self-balancing imaging drum. In the most preferred embodiment, the self-balancing imaging drum has a large number of balance correctors disposed in the wall of the self-balancing imaging drum.

A self-balancing imaging drum for supporting print media comprises an external surface having a plurality of vacuum holes extending from the hollowed-out interior portion of the self-balancing imaging drum. A first vacuum supply is formed in the hollowed-out interior portion thereby communicating vacuum through the plurality of vacuum holes for holding print media onto the external surface of the self-balancing imaging drum. At least one balance corrector consists of a vacuum cylinder for housing a balancing ring with a return spring mounted in the wall of the self-balancing imaging drum such that when the self-balancing imaging drum is rotated, if no print media is present, the balancing ring moves outwardly to correct the balance of the self-balancing imaging drum and further the balancing ring blocks the vacuum passage to the first vacuum supply thus increasing the efficiency of the first vacuum supply. In the most preferred embodiment, the self-balancing imaging drum has a large number of balance correctors disposed in the wall of the self-balancing imaging drum.

BRIEF DESCRIPTION OF THE DRAWINGS

A more complete understanding of the invention and its advantages will become apparent from the detailed description taken in conjunction with the accompanying drawings, wherein examples of the invention are shown, and identical reference numbers have been used, where possible, to designate identical elements that are common to the figures referenced below.

DETAILED DESCRIPTION OF THE INVENTION

Figure 1:
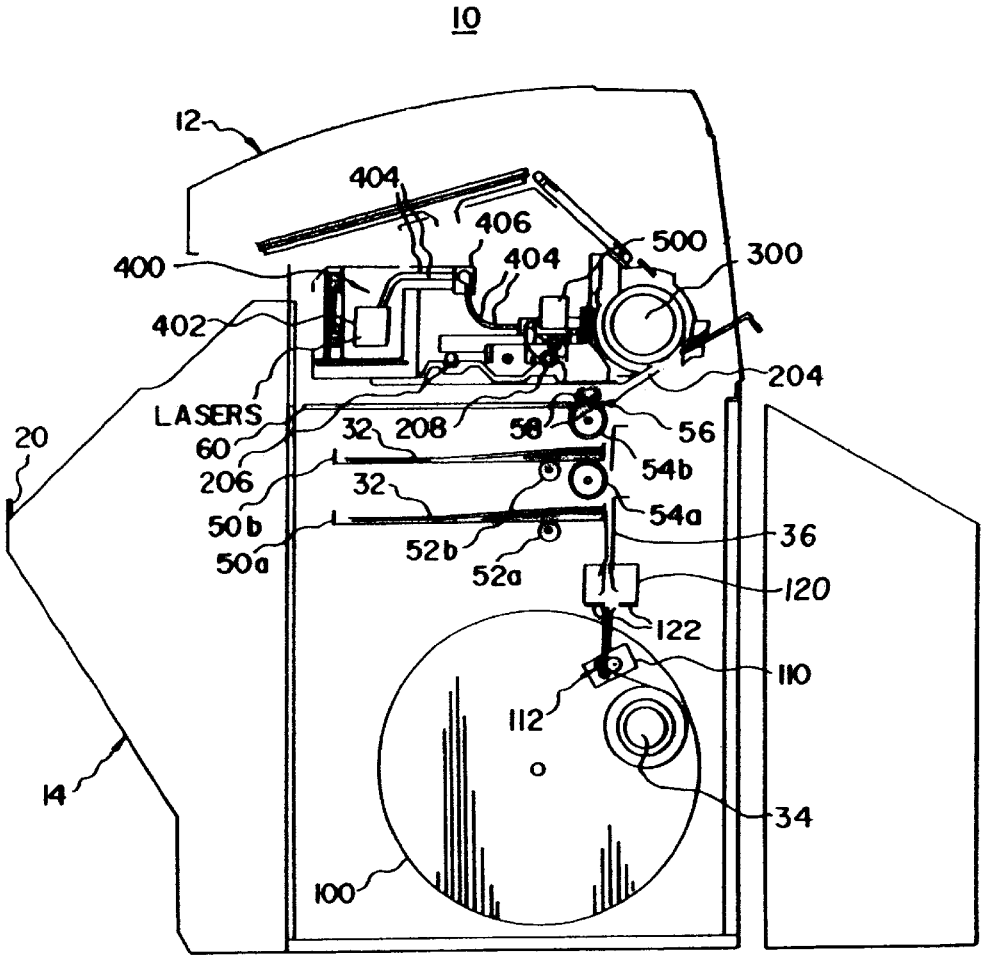
FIG. 1 is a side view in vertical cross-section of a self-balancing image processing apparatus according to the present invention.

In the following description, like reference characters designate like or corresponding parts throughout the several views. Also, in the following description, it is to be understood that such terms as "front," "rear," "lower,""upper," and the like are words of convenience and are not to be construed as limiting terms. Referring to the drawings, the invention will be described in more detail. It should be understood that while the invention will be described as being utilized in an image processing apparatus it could be utilized to provide a self-balancing drum for other applications well known in the art.

Referring to FIG. 1, a self-balancing image processing apparatus 10 according to the present invention is shown, which includes an image processor housing 12, which provides a protective cover for the self-balancing image processing apparatus 10. The self-balancing image processing apparatus 10 also includes a hinged image processor door 14, which is attached to the front portion of the image processor housing 12 and permits access to the two sheet material trays. A lower sheet material tray 50*a* and upper sheet material tray 50*b* are positioned in the interior portion of the image processor housing 12 for supporting print media 32. Only one of the sheet material trays will dispense the print media 32 to create an intended image thereon. The alternate sheet material tray either holds an alternative type of media, or functions as a back up for print media 32. In this regard, lower sheet material tray 50*a* includes a lower media lift cam 52*a*, which is used to lift the lower sheet material tray 50*a* and, ultimately, the print media 32 upwardly toward lower media roller 54*a* and upper media roller 54*b*. When the media rollers 54*a* and 54*b* are rotated, the upward media 32 is pulled upwardly towards a media guide 56. The upper sheet material tray 50*b* includes an upper media lift cam 52*b* for lifting the upper sheet material tray 50*b* towards the upper media roller 54*b*.

Continuing with FIG. 1, the movable media guide 56 directs the print media 32 under a pair of media guide rollers 58. This engages the print media 32 for assisting the upper media roller 54*b* in directing it onto the media staging tray 60. Media guide 56 is attached and hinged to the lathe bed scanning frame at one end, and is uninhibited at its other end for permitting multiple positioning of the media guide 56. The media guide 56 then rotates the uninhibited end downwardly, as illustrated. The direction of rotation of the upper media roller 54*b* is reversed for moving the print media 32, which is resting on the media staging tray 60, under the pair of media guide rollers 58 upwardly through an entrance passageway 204 and up to the self-balancing imaging drum 300.

A roll of donor material 34 is connected to the print media carousel 100 in a lower portion of the image processor housing 12, as shown in FIG. 1. Four rolls are ordinarily used, but, for clarity, only one is shown in FIG. 1. Each roll includes a donor material 34 of a different color, typically black, yellow, magenta, and cyan. These dye donor materials 34 are ultimately cut into donor sheet materials 36 and passed to the self-balancing imaging drum 300 for forming the medium from which colorants thereon are passed to the print media 32 resting thereon. In this regard, a media drive mechanism 110 is attached to each roll of donor material 34, and includes three media drive rollers 112 through which the donor material 34 of interest is metered upwardly into a media knife assembly 120. After the donor material 34 reaches a predetermined position, the media drive rollers 112 cease driving the donor material 34. The media knife assembly 120 cuts the donor material 34 into donor sheet materials 36. The lower media roller 54*a* and the upper media roller 54*b* along with the media guide 56 then pass the donor sheet material 36 onto the media staging tray 60 and ultimately to the self-balancing imaging drum 300.

As shown in FIG. 1, a laser assembly 400 includes a quantity of laser diodes 402 in its interior. The lasers are connected via fiber optic cables 404 to a distribution block 406 and ultimately to a printhead 500. The printhead 500 directs thermal energy received from the laser diodes 402. This causes the donor sheet material 36 to pass the desired colorant to the print media 32. The printhead 500 attaches to a lead screw. A lead screw drive nut and drive coupling (not shown) permit axial movement along the longitudinal axis of the self-balancing imaging drum 300 for transferring the data to create the intended image onto the print media 32.

Figure 2:
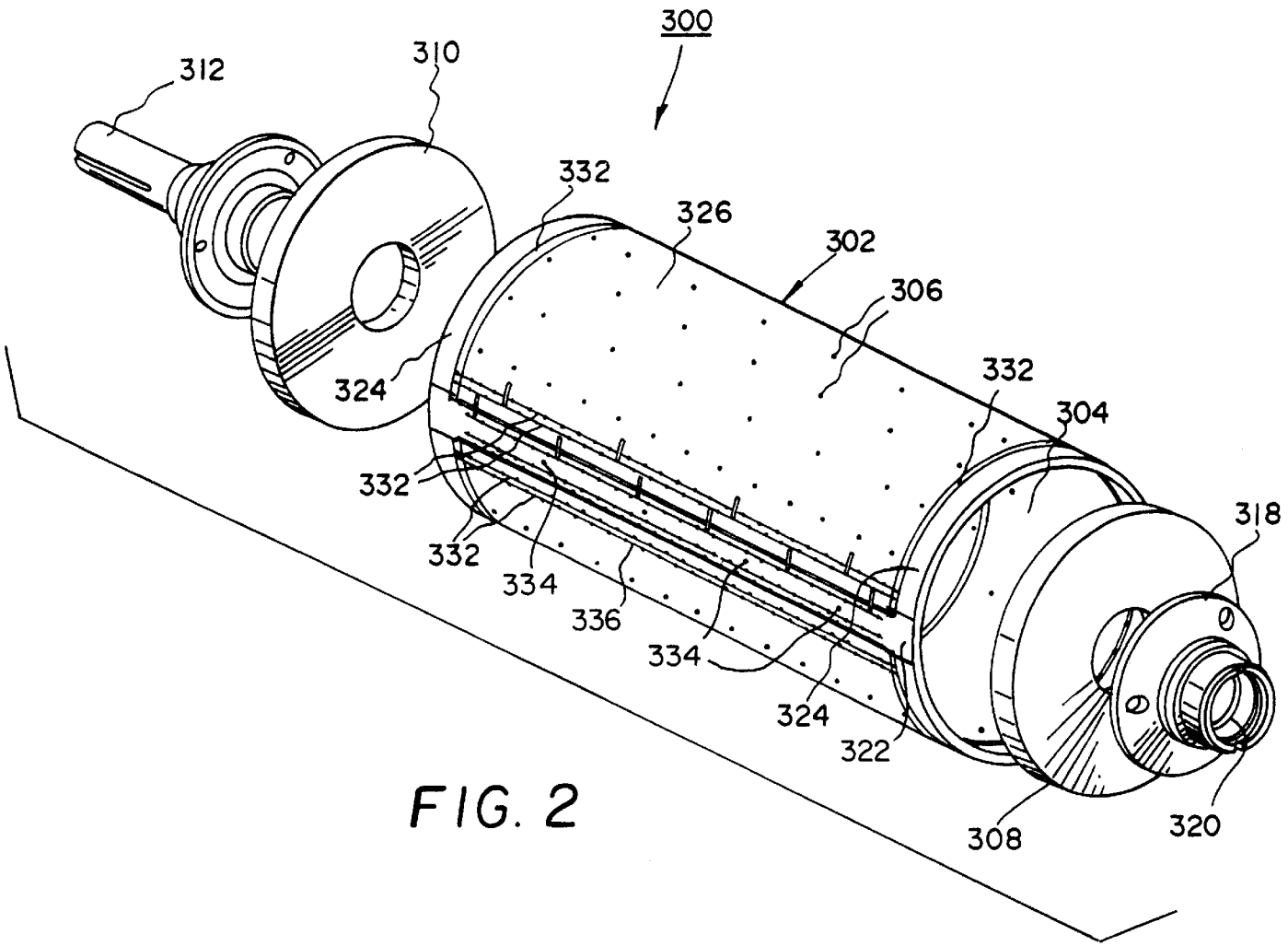
FIG. 2 is an exploded, perspective view of a self-balancing imaging drum according to the present invention.

As shown in FIG. 2, the vacuum spindle 318 is provided with a central vacuum opening 320. The central vacuum opening 320 is in alignment with a vacuum fitting (not shown) with an external flange that is rigidly mounted to the lathe bed-scanning frame. The vacuum fitting (not shown) has an extension, which extends within but is closely spaced from the vacuum spindle 318, thus forming a small clearance. With this configuration, a slight vacuum leak is provided between the outer diameter of the vacuum fitting (not shown) and the inner diameter of the central vacuum opening 320 of the vacuum spindle 318. This assures that no contact exists between the vacuum fitting (not shown) and the self-balancing imaging drum 300 that might impart uneven movement or jitters to the self-balancing imaging drum 300 during its rotation. The opposite end of the vacuum fitting (not shown) is connected to a blower (not shown), which is capable of producing 50–60 inches of water at an airflow volume of 60–70 CFM. The blower provides vacuum to the self-balancing imaging drum 300. The vacuum blower provides the various internal vacuum levels required during loading, scanning and unloading of the print media 32 and the donor sheet materials 36 to create the intended image. With no media loaded on the self-balancing imaging drum 300; the internal vacuum level of the self-balancing imaging drum 300 is preferably approximately 10–15 inches of water. With just the print media 32 loaded on the self-balancing imaging drum 300, the internal vacuum level of the self-balancing imaging drum 300 is preferably approximately 20–25 inches of water. This level is desired so that when a donor sheet material 36 is removed, the print media 32 does not move and color-to-color registration is maintained. With both the print media 32 and donor sheet material 36 completely loaded on self-balancing imaging drum 300, the internal vacuum level of the self-balancing imaging drum 300 is approximately 50–60 inches of water in this embodiment. In operation, vacuum is applied through the vacuum holes 306 extending through the drum housing 302. The vacuum supports and maintains the position of the print media 32 and donor sheet material 36 as the self-balancing imaging drum 300 is rotated. The ends of the self-balancing imaging drum 300 are enclosed by the vacuum end plate 308 with a centrally disposed vacuum spindle 318 and the drive end plate 310 with a centrally disposed drive spindle 312, which are each provided with a centrally disposed spindle 318. The spindles extend outwardly through support bearings (not shown) and are supported by the scanning frame. The outer surface of the self-balancing imaging drum 300 is provided with an axially extending flat 322, which preferably extends approximately 8 degrees of the self-balancing imaging drum 300 circumference. The self-balancing imaging drum 300 is provided with donor support rings 324, which form a radial recess 326 (see FIG. 4). The recess extends radially from one side of the axially extending flat 322 around the self-balancing imaging drum 300 to the other side of the axially extending flat 322, from approximately one inch from one end of the self-balancing imaging drum 300 to approximately one inch from the other end of the self-balancing imaging drum 300. The print media 32 when mounted on the self-balancing imaging drum 300 is seated within the radial recess 326. Therefore, the donor support rings 324 have a thickness, which is substantially equal to the thickness of the print media 32 seated there between. In this embodiment, this thickness is 0.004 inches. The purpose of the radial recess 326 on the self-balancing imaging drum 300 surface is to eliminate any creases in the donor sheet material 36, as the materials are drawn down over the print media 32 during the loading of the donor sheet material 36. This ensures that no folds or creases will be generated in the donor sheet material 36, which could extend into the image area and seriously adversely affect the intended image. The radial recess 326 also substantially eliminates the entrapment of air along the edge of the print media 32, the vacuum holes 306 in the self-balancing imaging drum 300 surface cannot always ensure the removal of the entrapped air. Any residual air between the print media 32 and the donor sheet material 36 can also adversely affect the intended image. It should be noted that the invention is not limited to a self-balancing imaging drum 300 having a radial recess 326, donor support rings 324 or an axially extending flat 322.

Figure 3:
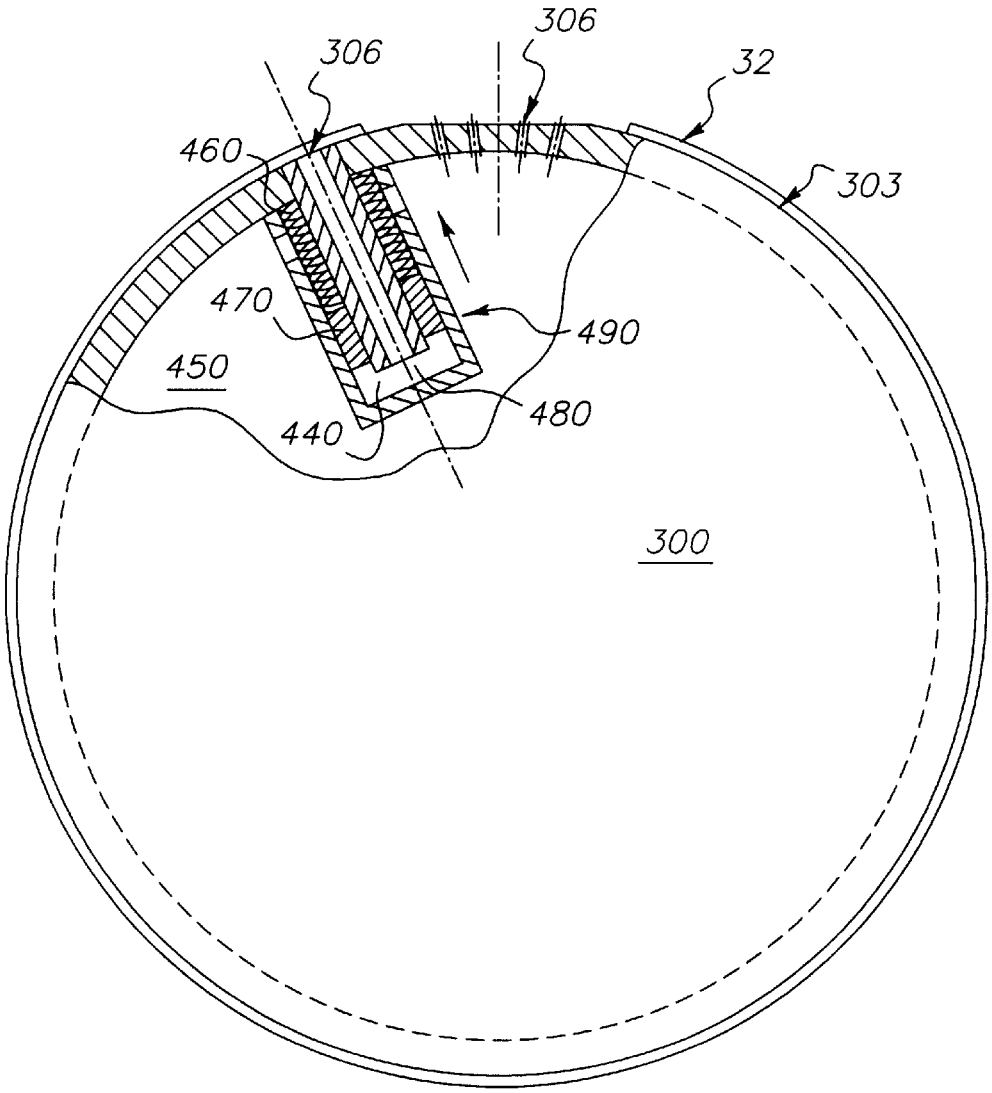
FIG. 3 shows section view of the self-balancing imaging drum, with a balance corrector and media over said balance corrector according to the present invention.

FIG. 3 shows section view of the self-balancing imaging drum, with a balance corrector and media over said balance corrector according to the present invention.

Figure 4:
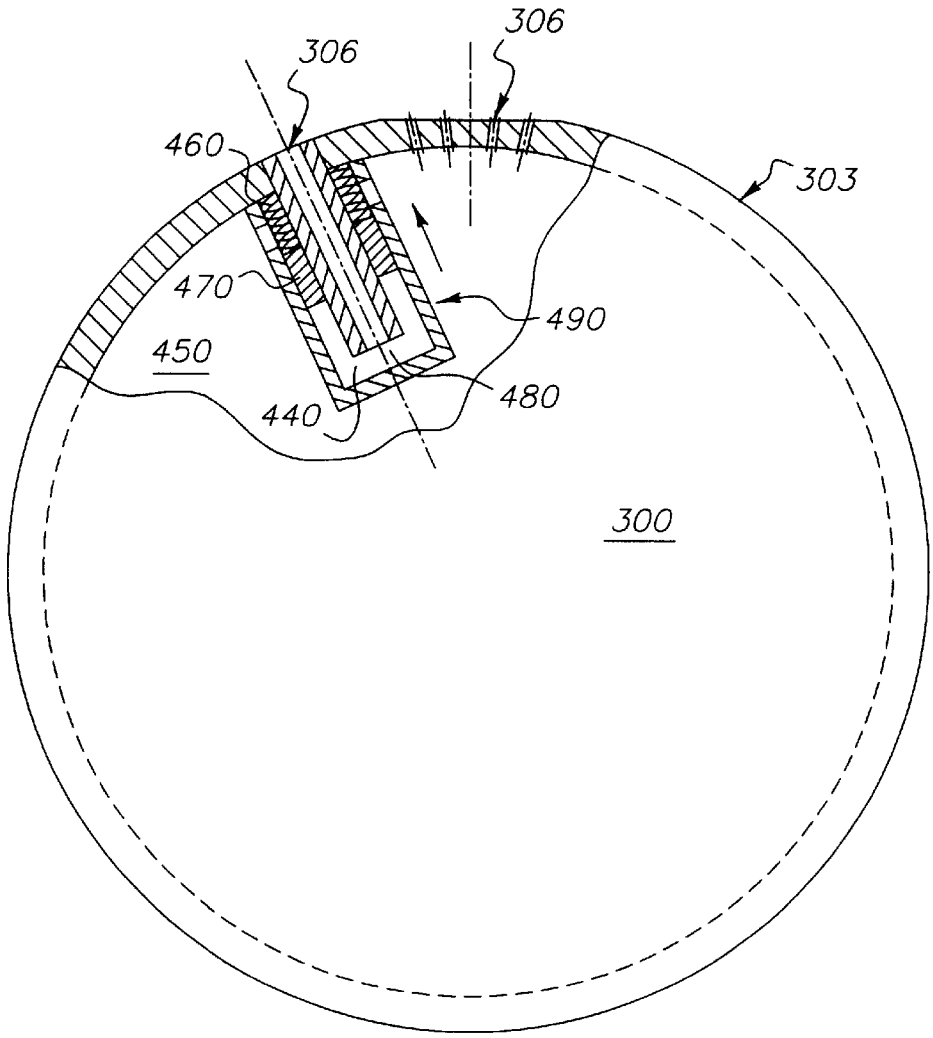
FIG. 4 shows section view of the self-balancing imaging drum, with a balance corrector and no media over said balance corrector according to the present invention.

FIG. 4 shows section view of the self-balancing imaging drum, with a balance corrector and no media over said balance corrector according to the present invention.

Figure 5:
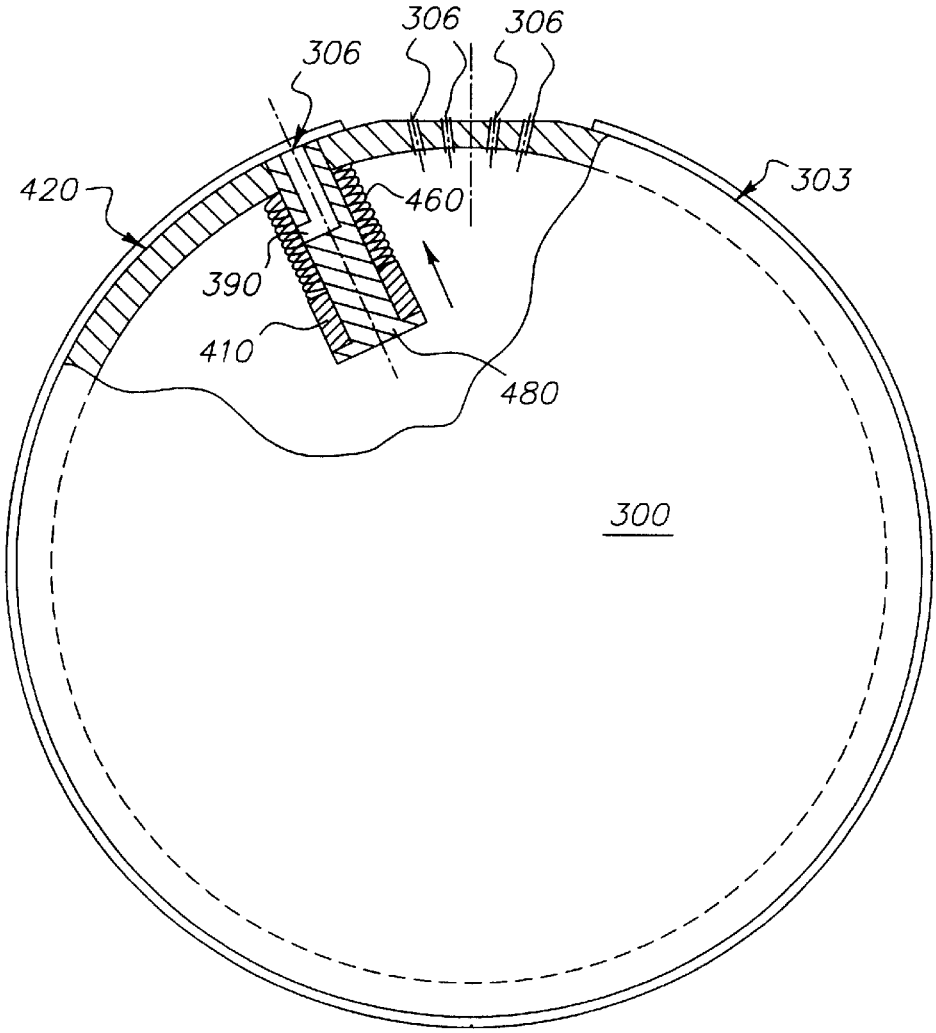
FIG. 5 shows section view of the self-balancing imaging drum, with a balance corrector and media over said balance corrector according to the present invention.

FIG. 5 shows section view of the self-balancing imaging drum, with a balance corrector and media over said balance corrector according to the present invention.

Figure 6:
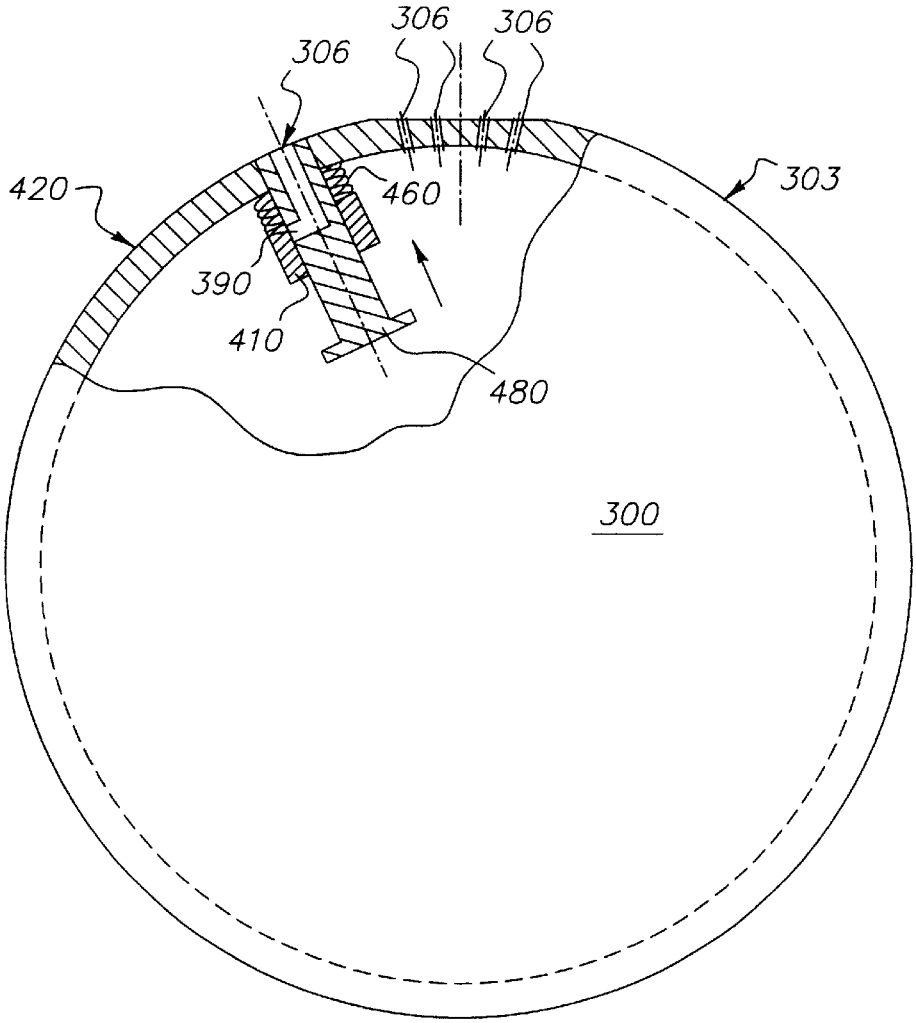
FIG. 6 shows section view of the self-balancing imaging drum, with a balance corrector and no media over said balance corrector according to the present invention.

FIG. 6 shows section view of the self-balancing imaging drum, with a balance corrector and no media over said balance corrector according to the present invention.

A self-balancing image processing apparatus 10 for writing an intended image to print media 32 comprises a self-balancing imaging drum 300 having an external surface 303 with a plurality of vacuum holes 306 for supporting the print media 32. A printhead 500 forms an intended image on the print media 32. A drive motor 64 rotates the self-balancing imaging drum 300. A blower 330 creates a first vacuum supply 450 to the self-balancing imaging drum 300 for holding the print media 32 on the external surface 303 of the self-balancing imaging drum 300. At least one balance corrector 490 consists of a vacuum cylinder 480 for housing a vacuum piston 470 with a return spring 460 mounted in the wall of the self-balancing imaging drum 300 for creating a second vacuum supply 440 to the external surface 303 for holding the print media 32. The balance corrector 490 is adapted to allow the vacuum piston 470 to move outwardly to compensate for the lack of print media 32 or-media of a different size on the external surface 303 of the self-balancing imaging drum 300 thus correcting the balance of the self-balancing imaging drum, 300. In the most preferred embodiment, the self-balancing imaging drum 300 has a large number of balance correctors 490 disposed in the wall of the self-balancing imaging drum 300.

A method for loading and unloading print media 32 from a self-balancing imaging drum 300 comprises creating a first vacuum supply 490 in a hollowed-out interior portion 304. The self-balancing imaging drum 300 has an external surface 303 with a plurality of vacuum holes 306 communicating with the first vacuum supply 490 within the hollowed-out interior portion 304 of the self-balancing imaging drum 300. The print media 32 is loaded on the external surface 303 of the self-balancing imaging drum 300 wherein the print media 32 is held on the external surface 303 by means of vacuum drawn through the plurality of vacuum holes 306 on the external surface 303. The self-balancing imaging drum 300 is rotated forming a second vacuum supply 440 to the external surface 303 of the self-balancing imaging drum 300 during rotation using at least one balance corrector 490 consisting of a vacuum cylinder 480 for housing a vacuum piston 470 with a return spring 460 mounted in the wall of the self-balancing imaging drum 300. If no print media 32 is disposed over at least one of the balance correctors 490, the balance corrector 490 allows a vacuum piston 470 to move outwardly to compensate for the lack of print media 32 or media of a different size on the external surface 303 of the self-balancing imaging drum 300 correcting the balance of the self-balancing imaging drum 300.

In the operation of the invention, it is contemplated that the vacuum level of the first vacuum supply 450 may be varied using a vacuum supply controller (not shown). For the second vacuum supply 440 it is contemplated that it could also be varied with a vacuum supply controller, but more preferably the second vacuum supply is varied with the rotational speed of the self-balancing imaging drum 300, and no additional equipment is needed, reducing the expense of the equipment. If a vacuum supply controller is used, it is contemplated that the vacuum supply controller can vary the speed of the blower by pulse width modulation of the DC voltage level to the blower.

A self-balancing imaging drum 300 for supporting print media 32 comprises an external surface 303 having a plurality of vacuum holes 306 extending from the hollowed-out interior portion 304 of the self-balancing imaging drum 300. A first vacuum supply 450 is formed in the hollowed-out interior portion 304 thereby communicating vacuum through the plurality of vacuum holes 306 for holding print media 32 onto the external surface 303 of the self-balancing imaging drum 300. At least one balance corrector 490 consists of a vacuum cylinder 480 for housing a vacuum piston 470 with a return spring 460 mounted in the wall 420 of the self-balancing imaging drum 300 such that when the self-balancing imaging drum 300 is rotated it generates a second vacuum supply 440 to the external surface of the self-balancing imaging drum 300 for holding the print media 32. If no print media 32 or media of a different size is present the vacuum piston 470 moves outwardly to correct the balance of the self-balancing imaging drum 300. In the most preferred embodiment, the self-balancing imaging drum 300 has a large number of balance correctors 490 disposed in the wall of the self-balancing imaging drum 300.

A self-balancing imaging drum 300 for supporting print media 32 comprises an.external surface 303 having a plurality of vacuum holes 306 extending from the hollowed-out interior portion 304 of the self-balancing imaging drum 300. A first vacuum supply 450 is formed in the hollowed-out interior portion 304 thereby communicating vacuum through the plurality of vacuum holes 306 for holding print media 32 onto the external surface 303 of the self-balancing imaging drum 300. At least one balance corrector 490 consists of a vacuum cylinder 480 for housing a balancing ring 410 with a return spring 460 mounted in the wall 420 of the self-balancing imaging drum 300 such that when the self-balancing imaging drum 300 is rotated, if no print media 32 is present or media of a different size the balancing ring 410 moves outwardly to correct the balance of the self-balancing imaging drum 300. The balancing ring 410 blocks the vacuum passage 390 to the first vacuum supply 450 thus increasing the efficiency of the first vacuum supply 450. In the most preferred embodiment, the self-balancing imaging drum 300 has a large number of balance correctors 490 disposed in the wall of the self-balancing imaging drum 300.

Accordingly, the present invention provides a process and self balancing image processing apparatus 10 for consistently, quickly and accurately generating an intended image utilizing such an imaging process to create high quality, accurate, and consistent intended images, which process and apparatus is substantially automated to improve the control, quality and productivity of the imaging process while minimizing the attendance and labor necessary. Moreover, the self balancing image processing apparatus 10 is capable of not only generating this high quality intended image consistently, but is capable of creating a multi-color intended image which is in registration regardless of how the various individual intended images are supplied to the element comprising the final intended image. Thus, the present invention provides both a process and self-balancing image processing apparatus 10 in which the various donor sheet materials 36 are sequentially superposed with a single print media 32 sheet and then removed.

The invention has been described in detail with particular reference to certain preferred embodiments thereof, but it will be understood that variations and modifications can be effected within the spirit and scope of the invention as described hereinabove and as defined in the appended claims by a person of ordinary skill in the art, without departing from the scope of the invention. While preferred embodiments of the invention have been described using specific terms, this description is for illustrative purposes only. It is intended that the doctrine of equivalents be relied upon to determine the fair scope of these claims in connection with any other person's product which fall outside the literal wording of these claims, but which in reality do not materially depart from this invention.

PARTS LIST

| | |
|---|---|
| 10. | Self-balancing image processing apparatus |
| 12. | Image processor housing |
| 14. | Image processor door |
| 30. | Roll media |
| 32. | Print media |
| 34. | Donor roll material |
| 36. | Donor sheet material |
| 50a. | Lower sheet material tray |
| 50b. | Upper sheet material tray |
| 52a. | Lower media lift cam |
| 52b. | Upper media lift cam |
| 54a. | Lower media roller |
| 54b. | Upper media roller |
| 56. | Media guide |
| 58. | Media guide rollers |
| 60. | Media staging tray |
| 100. | Media carousel |
| 110. | Media drive mechanism |
| 112. | Media drive rollers |
| 120. | Media knife assembly |
| 202. | Lathe bed scanning frame |
| 204. | Entrance passageway |
| 300. | Self-balancing imaging drum |
| 302. | Drum housing |
| 303. | External surface |
| 304. | Hollowed-out interior portion |
| 306. | Vacuum holes |
| 308. | Vacuum end plate |
| 310. | Drive end plate |
| 312. | Drive spindle |
| 318. | Vacuum spindle |

-continued

| PARTS LIST | |
|---|---|
| 320. | Central vacuum opening |
| 322. | Axially extending flat |
| 324. | Donor support ring |
| 326. | Radial recess |
| 390. | Vacuum passage |
| 400. | Laser assembly |
| 402. | Laser diodes |
| 404. | Fiber optic cables |
| 406. | Distribution block |
| 410. | Balancing ring |
| 420. | Drum wall |
| 440. | Second vacuum supply |
| 450. | First vacuum supply |
| 460. | Return spring |
| 470. | Vacuum piston |
| 480. | Vacuum cylinder |
| 490. | Balance corrector |
| 500. | Printhead |

What is claimed is:

1. A self-balancing image processing apparatus for forming intended images onto print media comprising:

a self-balancing imaging drum having an external surface with a plurality of vacuum holes for supporting said print media;

a printhead for forming an image on said print media;

a motor for rotating said self-balancing imaging drum;

a blower for creating a first vacuum supply to said self-balancing imaging drum for holding said print media on said external surface of said self-balancing imaging drum; and at least one balance corrector consisting of a vacuum cylinder for housing a vacuum piston with a return spring mounted in the wall of said self-balancing imaging drum creating a second vacuum supply to said external surface and wherein said balance corrector is adapted to move radially to a position to correct the balance of said self-balancing imaging drum if print media is not covering said balance corrector.

2. The self-balancing image processing apparatus according to claim 1, wherein said first vacuum supply and said second vacuum supply are reduced for loading said print media onto said external surface.

3. The self-balancing image processing apparatus according to claim 1, wherein said at least one balance corrector upon rotation of the self-balancing imaging drum forms at least one vacuum chamber which communicates with at least one evacuation passage which communicates said second vacuum supply to the external surface via said vacuum holes.

4. The self-balancing image processing apparatus according to claim 1, wherein said first vacuum supply is varied using a vacuum supply controller.

5. The self-balancing image processing apparatus according to claim 1, wherein said second vacuum supply is varied with the rotational speed of the self-balancing imaging drum.

6. The self-balancing image processing apparatus according to claim 5, wherein said vacuum supply controller varies the speed of said blower by pulse width modulation of a DC voltage level to said blower.

7. The self-balancing image processing apparatus according to claim 1, wherein a donor material covers said print media.

8. The self-balancing image processing apparatus according to claim 1, wherein said image processing apparatus is a laser thermal printer.

9. The self-balancing image processing apparatus according to claim 1, wherein a dye donor material overlays said print media and said printhead writes an image to said print media by transferring from said dye donor material to said print media.

10. The self-balancing image processing apparatus according to claim 1, wherein the self-balancing image processing apparatus is a film writer.

11. The self-balancing image processing apparatus according to claim 1, wherein the self-balancing image processing apparatus is a laser thermal film writer.

12. A method for balancing a self-balancing imaging drum having an external surface with a plurality of vacuum holes, comprising the steps of:

creating a first vacuum supply to the external surface;

rotating said self-balancing imaging drum;

loading said print media on said external surface of said self-balancing imaging drum wherein said print media is held on at least a portion of said vacuum holes connecting a hollowed-out interior portion of said self-balancing imaging drum to said external surface;

rotating said self-balancing imaging drum; and using at least one balance corrector consisting of at least one vacuum cylinder to form a second vacuum supply during the rotation of said drum, and communicating said second vacuum supply to said vacuum holes thereby, and if said print media does not cover at least one vacuum hole, the balance corrector moves radially to a position to correct balance of the self-balancing imaging drum for the missing print media.

13. The method as in claim 12, comprising the additional steps of:

slowing the rotation of said self-balancing imaging drum speed thereby decreasing the second vacuum supply to the surface of said self-balancing imaging drum; and unloading said print media.

14. A self-balancing imaging drum for supporting print media comprising:

an external surface surrounding an interior portion;

a plurality of vacuum holes piercing said external surface; first vacuum supply for holding print media onto said external surface through said plurality of vacuum holes; and at least one balance corrector consisting of a vacuum cylinder mounted in one of said end walls for creating a second vacuum supply to said plurality of vacuum holes and wherein said balance corrector is adapted to move radially to a position to correct the balance of the self-balancing imaging drum if print media is not covering all the plurality of vacuum holes.

15. The self-balancing imaging drum of claim 14, wherein said vacuum cylinder is a vacuum piston.

16. The balance correcting self-balancing imaging drum according to claim 14, wherein said first vacuum supply and said second vacuum supply are reduced for loading print media onto said surface.

17. The balance correcting self-balancing imaging drum according to claim 16, wherein said first vacuum supply is varied using a vacuum supply controller.

18. The self-balancing imaging drum according to claim 16, wherein said second vacuum supply is varied with the balance correcting self-balancing imaging drum rotational speed.

19. The self-balancing imaging drum according to claim 16, wherein said balance corrector is an automatic adjusting device.

20. The balance correcting self-balancing imaging drum according to claim 14, wherein said at least one vacuum cylinder upon rotation of the self-balancing imaging drum forms a vacuum chamber which communicates with evacuation passage which provides the second vacuum supply to the surface.

21. A method for balancing an self-balancing imaging drum wherein said drum has a surface with a plurality of vacuum holes and at least one vacuum piston communicating with at least one vacuum hole, comprising the steps of:

loading print media on the surface of the drum wherein said print media is held on said surface through a first vacuum supply drawing through at least one of said plurality of vacuum holes;

rotating said self balancing imaging drum; and if no print media is over at least one hole, then the vacuum piston communicating with that vacuum hole will move radially to a position to correct balance of the self-balancing imaging drum for the missing print media.

22. The method as in claim 21, comprising the additional steps of:

slowing said self-balancing imaging drum thereby decreasing the second vacuum supply to the surface; and unloading said print media.

23. A self-balancing image processing apparatus for forming images on print media comprising:

an imaging drum comprising:

an external surface;

a plurality of holes disposed in said external surface;

a printhead for forming an image on said print media adjacent to said imaging drum;

a motor for rotating said imaging drum connected to said drum;

a blower for creating a first vacuum supply for said imaging drum, and wherein said first vacuum supply is connected to said central vacuum opening;

at least one balance corrector engaging at least one vacuum hole, wherein said balance corrector comprises:

a vacuum cylinder;

a vacuum piston contained within said vacuum cylinder; and a return spring to radially move the balance corrector when print media is over said at least one vacuum hole imaging.

* * * * *